United States Patent [19]

Junkers

[11] Patent Number: 4,753,139

[45] Date of Patent: Jun. 28, 1988

[54] FLUID-OPERATED WRENCH

[76] Inventor: John K. Junkers, 7 Arrowhead La., Saddle River, N.J. 07458

[21] Appl. No.: 913,741

[22] Filed: Sep. 30, 1986

[51] Int. Cl.[4] ..... B25B 13/46

[52] U.S. Cl. ..... 81/57.39; 81/57.44

[58] Field of Search ..... 81/54, 57.36, 57.39, 81/57.44

[56] References Cited

U.S. PATENT DOCUMENTS

| | | | |
|---|---|---|---|
| 3,745,858 | 7/1973 | Biach | 81/57.39 |
| 4,200,011 | 4/1980 | Wilmeth | 81/57.39 |
| 4,201,099 | 5/1980 | Junkers | 81/57.39 |
| 4,387,611 | 6/1983 | Junkers | 81/57.36 |
| 4,406,185 | 9/1983 | Junkers | 81/57.39 |
| 4,446,762 | 5/1984 | Junkers | 81/57.36 |
| 4,480,510 | 11/1984 | Aparicio Jr. et al. | 81/57.39 |

FOREIGN PATENT DOCUMENTS

| | | | |
|---|---|---|---|
| 628674 | 2/1980 | U.S.S.R. | 81/57.36 |

*Primary Examiner*—Frederick R. Schmidt
*Assistant Examiner*—Judy J. Hartman
*Attorney, Agent, or Firm*—Michael J. Striker

[57] ABSTRACT

A fluid-operated wrench has a reciprocable driving element having a driving end, and a lever arm element pivotable about an axis and having a connecting end pivotably connected with the reciprocable driving element by means of opening provided in the one end of one of the elements and having one straight side, and a sliding member having a side which slides over the straight side of the opening and being pivotably connected with the other element.

5 Claims, 3 Drawing Sheets

FLUID-OPERATED WRENCH

BACKGROUND OF THE INVENTION

The present invention relates to fluid-operated wrenches, and particularly to such fluid-operated wrenches which have a rigid reciprocable driving element and a lever arm pivotably connected with the reciprocable driving element.

Fluid-operated wrenches of the above mentioned general type are known in the art. In the known fluid-operated wrenches one end of a rigid reciprocable driving element which generally is a piston rod of a piston in a cylinder-piston unit, is connected with one end of a lever arm which is arranged pivotably about its pivot axis. The connection is performed by means of a pivot pin which extends through the proximal ends of the piston rod and the lever arm. One of the disadvantages of the above described connection is that when the lever arm pivots under the action of the piston rod about its pivot axis, the end of the lever arm which is connected to the piston rod applies unwanted side loads to the piston rod. It is to be understood that this phenomenon is very undesirable and can lead to a premature wear or breakage of the respective parts.

SUMMARY OF THE INVENTION

Accordingly, it is an object of the present invention to provide a fluid-operated wrench which avoids the disadvantages of the prior art.

In keeping with these objects and with others which will become apparent hereinafter, one feature of the present invention resides, briefly stated, in a fluid-operated wrench which has a rigid reciprocable driving element with at least one driving end, a lever arm element with at least one connecting end and pivotable about its pivot axis, and connecting means for pivotably connecting one end of the reciprocable driving element with one end of the lever arm element and including an opening formed in one end of one of the elements and having a straight side, and a sliding member which is pivotably connected with the other element and has one side which slides over the straight side of the opening.

When the fluid-operated wrench is designed in accordance with the present invention, during pivoting of the lever arm element about its pivot axis under the action of the reciprocable driving element, the sliding member adjusts to a radial movement within the opening by sliding with a surface contact, so that no unwanted side loads are applied to the rigid reciprocable driving element.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
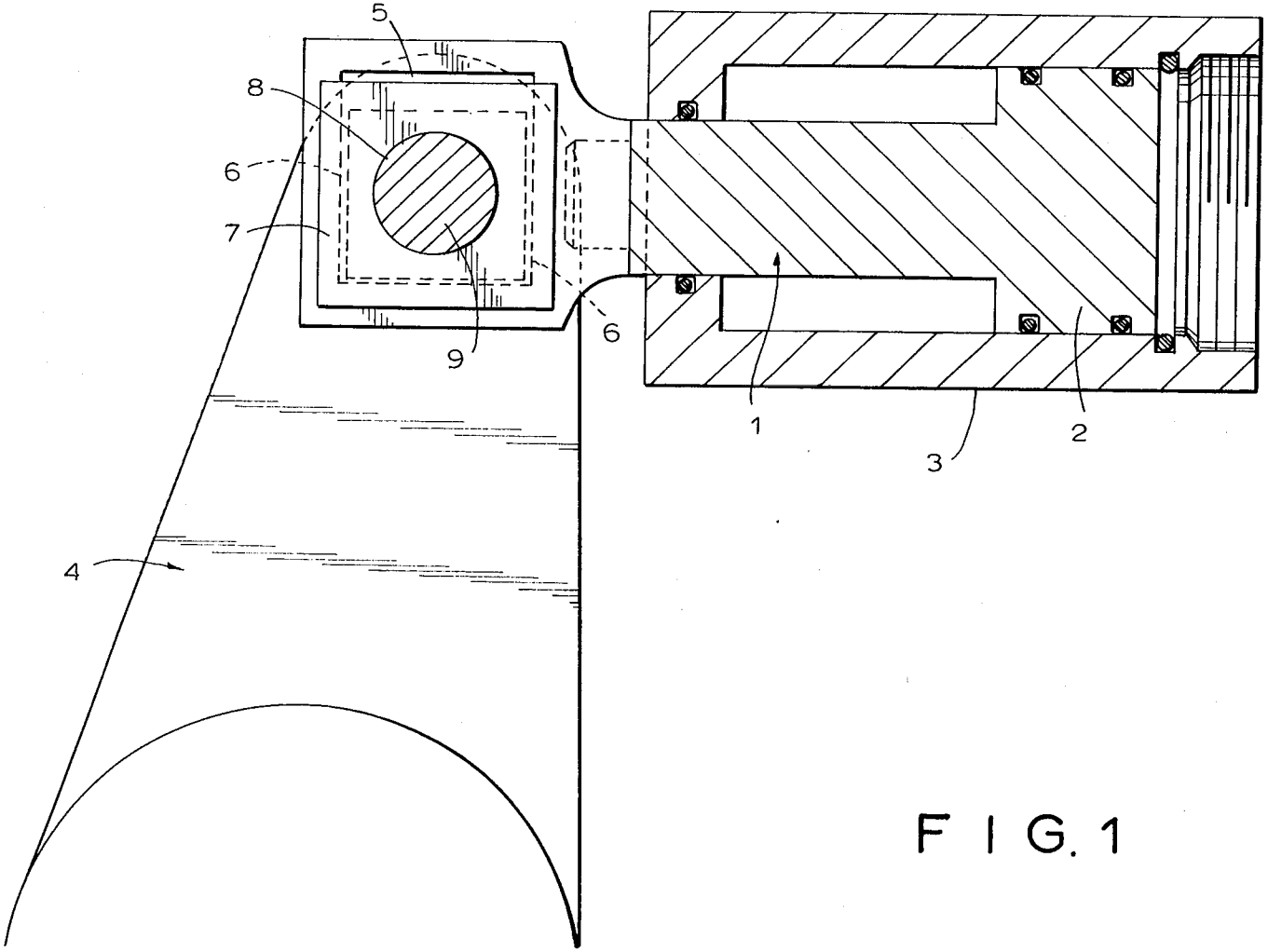
FIG. 1 is a side view schematically showing a fluid-operated wrench in accordance with the present invention, and more particularly its parts which are important for the present invention.

A fluid-operated wrench in accordance with the present invention has a reciprocable driving element which is identified with reference numeral 1. As shown in the drawing, the reciprocable driving element is a piston rod which is attached to a piston 2 and reciprocates in a cylinder 3 of a cylinder-piston unit of the wrench. While one end of the piston rod 1 is connected with the piston 2, its opposite end is spaced from the piston 2 and is located outside of the cylinder 3.

The fluid-operated wrench further has a lever arm 4 pivotably connected with the piston rod 1 of the cylinder-piston unit. The lever arm 4 carries at its one end an engaging member such as for example a ratchet which is not shown in the drawing and which engages a threaded connector to be tightened or loosened. The lever arm 4 pivots about its axis identified with reference numeral 1, for tightening or loosening a threaded connector. The end of the lever arm 4 is pivotably connected with the end of the piston rod 1, so that during reciprocation of the piston rod 1 under the action of working medium in the cylinder-piston unit, the lever arm 4 pivots about its pivot axis A. The pivotal connection of the lever arm 4 with the piston rod 1 is performed with the aid of connecting means which constitute the novel features of the present invention. The end of the piston rod 1 is provided with a four-cornered opening 5 which is elongated in a direction transverse to the direction of reciprocation of the piston rod 1. The opening 5 is formed by four inner surfaces in the end of the piston rod including small surfaces and long surfaces. The long surfaces are identified with reference numeral 6 and extend in the transverse direction. At least one of the long surfaces 6 is formed as a sliding surface for the purpose which will be explained hereinbelow. A sliding part 7 is arranged in the four-cornered opening 5 of the piston rod 1 so that it can slide in the transverse or radial direction relative to the pivot axis A with a sliding contact with at least one of the long surfaces 6.

Figure 2:
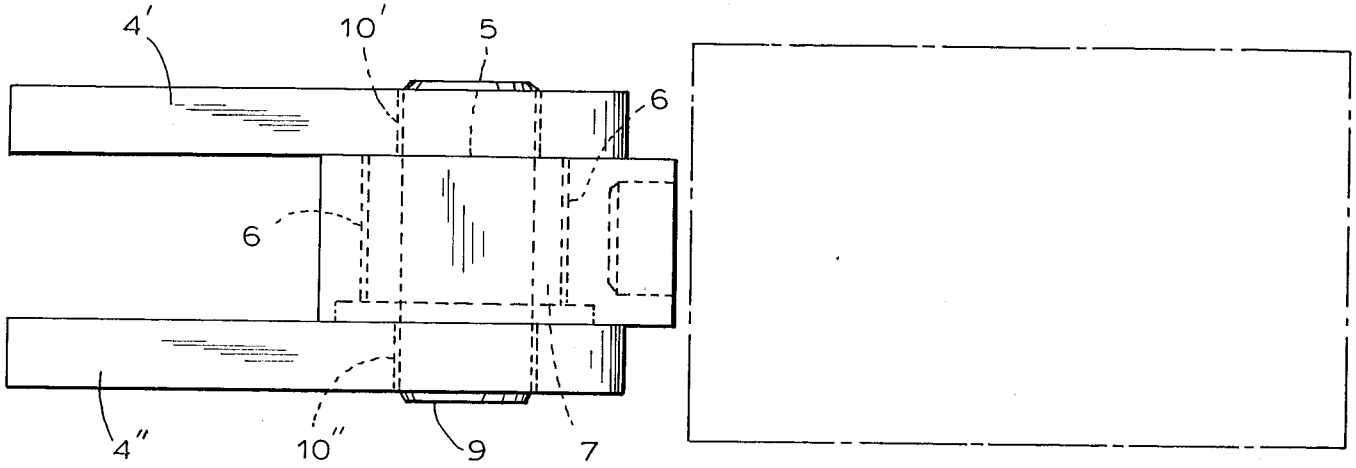
FIG. 2 is a plan view of the connection area of the fluid-operated wrench of FIG. 1; and FIC. 3 is a view showing some parts of the inventive fluid-operated wrench.
Figure 3:
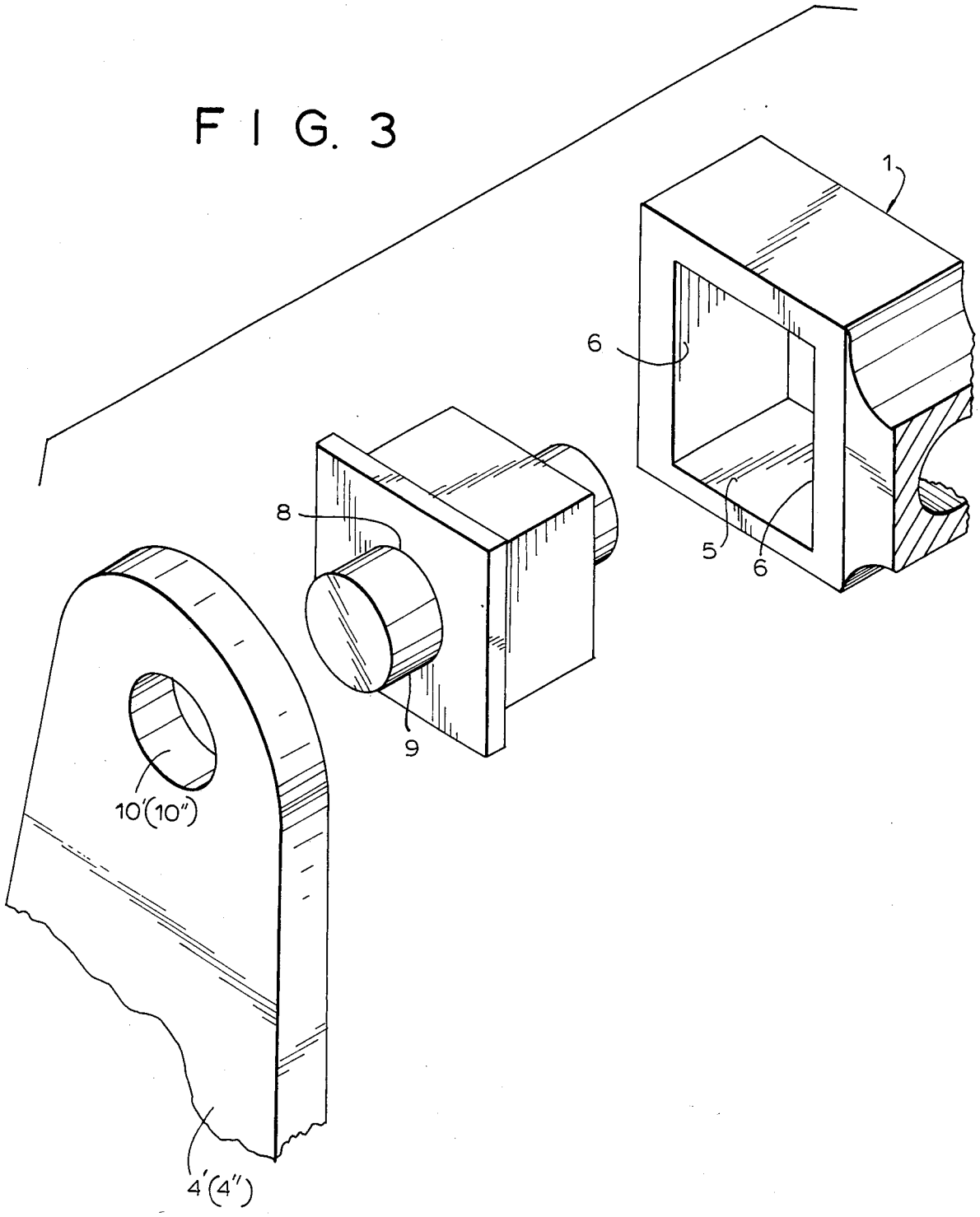

This sliding part 7 has a substantially central opening 8. A pin 9 extends through the central opening 8 and projects axially beyond the sliding part 7. As can be seen from FIG. 2, the lever arm 4 includes two plates 4' and 4'' each having a circular opening 10' or 10'', respectively. The plates 4' and 4'' are fitted on the projecting ends of the pin 9 by means of their openings 10' and 10'', at both axial ends of the sliding part 7.

During operation of the fluid-operated wrench, the piston 2 reciprocates in the cylinder 3 of the cylinder-piston unit, and the piston rod 1 follows the reciprocating movement of the piston 2. During reciprocating movement of the piston rod 1, the lever arm is pivoted about its pivot axis A and the connecting end of the lever arm 4 moves along an arc about the pivot axis A. The sliding part 7 slides in the four-cornered opening 5 substantially in the transverse or radial direction relative to the pivot axis A of the lever arm in a sliding contact with at least one of the long surfaces 6 which limit the opening 5. As a result of this, no unwanted side loads are applied to the piston rod 1 during pivoting of the lever arm 4.

It is to be understood that somewhat different embodiments can also be implemented within the basic idea of the present invention. For example, the sliding part 7 and the pin 9 can be formed as a one-piece member, the four-cornered opening 5 can be formed not in the end portion of the piston rod 1, but instead in the end portion of the lever arm 4, while the pin 9 can be pivotably connected with the end of the piston rod 1. It is to be understood that either the pin 9 is fixedly retained in the sliding part 7 and the arm 4 is pivotably fitted on the pin 9, or the pin 9 is fixedly connected with the lever arm 4 and pivots inside the central opening 8 of the sliding member 7.

It will be understood that each of the elements described above, or two or more together, may also find a useful application in other types of constructions differing from the types described above.

While the invention has been illustrated and described as embodied in a fluid-operated wrench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A fluid operated wrench, comprising a rigid reciprocable driving element having a driving end; a lever arm element pivotable about a pivot axis and having at least one connecting end; and means to prevent application of unwanted side loads, including means for connecting said reciprocable driving element with said lever arm element, said connecting means including a rectangular opening which is formed in said driving end, and a rectangular sliding member pivotably connected with said connecting end; said rectangular opening including guide means being a first pair of parallel sides for guiding said sliding member therebetween, said rectangular opening further including stop means being a second pair of parallel sides for determining maximum extent of travel of said sliding member, so that when said reciprocable driving element moves said driving end, said sliding means slides between said guide means, causing said connecting end and said sliding means to move along an arc described about said pivot axis.

2. A fluid-operated wrench as defined in claim 1, wherein said reciprocable driving element reciprocates along a straight line in a predetermined direction, said opening in said one end being elongated in a direction which is transverse to said predetermined direction.

3. A fluid-operated wrench as defined in claim 1, wherein said sliding member includes a sliding part which is slidably arranged in said opening, and a pin connected with said sliding part and pivotably connected with said other element.

4. A fluid-operated wrench as defined in claim 3, wherein said sliding part has a pin opening, said pin extending through said pin opening.

5. A fluid-operated wrench as defined in claim 4, wherein said pin opening has an axis, said pin extending axially beyond said sliding part and projecting outwardly at both axial sides thereof, said lever arm element including two lever arm plates each connected with said pin at respective sides of said sliding part.

* * * * *